US006533075B2

(12) United States Patent
Masuda

(10) Patent No.: US 6,533,075 B2
(45) Date of Patent: Mar. 18, 2003

(54) ELEVATOR GROUP SUPERVISORY CONTROL SYSTEM FOR PROCESSING HALL CALL INFORMATION

(75) Inventor: Toshio Masuda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/958,278

(22) PCT Filed: Mar. 28, 2000

(86) PCT No.: PCT/JP00/01914

§ 371 (c)(1),
(2), (4) Date: Oct. 9, 2001

(87) PCT Pub. No.: WO01/72623

PCT Pub. Date: Oct. 4, 2001

(65) Prior Publication Data

US 2003/0006100 A1 Jan. 9, 2003

(51) Int. Cl.[7] ..... B66B 1/18
(52) U.S. Cl. ..... 187/382; 187/247; 187/391
(58) Field of Search ..... 187/247, 248, 187/382, 391

(56) References Cited

U.S. PATENT DOCUMENTS 4,345,670 A * 8/1982 Kaneko et al. ..... 187/248
5,142,107 A * 8/1992 Yashiro ..... 187/247
5,387,769 A * 2/1995 Kupersmith et al. ..... 187/248
5,884,729 A 3/1999 Park et al.
5,932,851 A * 8/1999 Wang ..... 187/247
5,936,211 A 8/1999 Kim
5,955,708 A * 9/1999 Amano et al. ..... 187/247
6,378,662 B1 * 4/2002 Yamada ..... 187/247

FOREIGN PATENT DOCUMENTS

JP 04-055272 2/1992
JP 04-072278 3/1992
JP 6-87580 3/1994
JP 2001/233557 A * 8/2001

* cited by examiner

*Primary Examiner*—Jonathan Salata
(74) *Attorney, Agent, or Firm*—Leydig, Voit & Mayer, Ltd.

(57) ABSTRACT

An elevator group supervisory control system includes individual car control units which individually control elevator units, hall control units which control hall equipment including hall call buttons provided on each floor, a group supervisory control unit which processes assignment of elevators based on hall information transmitted from the plurality of hall control units, and a communication control unit having an independent power supply for each individual car control unit, the communication control unit being connected with a corresponding individual car control unit, a corresponding hall control unit, and the group a supervisory control unit for, data communications. The transmission paths of the communication control units and the group supervisory control unit are connected with each other through buses to constitute the elevator group supervisory control system. Thus, communications between the hall control units and the group supervisory control unit become effective even if the individual car control units are down, as a result of which it becomes unnecessary to connect the hall call buttons with the hall control units for backup purposes, simplifying arrangement of connections.

8 Claims, 7 Drawing Sheets

ELEVATOR GROUP SUPERVISORY CONTROL SYSTEM FOR PROCESSING HALL CALL INFORMATION

TECHNICAL FIELD

The present invention relates to an elevator group supervisory control system for assignment processing for a plurality of elevators in response to hall call button information.

BACKGROUND ART

FIG. 10 is a view illustrating the construction of a conventional elevator group supervisory control system described in Japanese Patent Application Laid-Open No. 4-55272.

In FIG. 10, 1–3 represent three individual car control units (designated at "CC" in this figure) which individually control three elevator cars #1–#3 (not shown), respectively, and 4–6 represent hall control units (designated at "HS" in this figure) for each floor and each elevator car for controlling hall equipment 8, 9. 8 and 9 represent the hall equipment comprising hall call buttons, indicator lamps and the like connected with the hall control units 4–6.

In the case of the system shown in FIG. 10, there are provided hall control devices 4*a*–4*n*, 5*a*–5*n*, and 6*a*–6*n* corresponding to respective floors. The hall control devices 4*a*–4*n* and 5*a*–5*n* are connected with hall call buttons 8*a*–8*n*, and the hall control devices 6*a*–6*n* are connected with hall call buttons 9*a*–9*n*. 10 represents a group supervisory control unit (designated at "GC" in FIG. 10) which performs assignment processing of the respective elevator units or cars based on hall information such as hall button information, etc., transmitted from the hall control units 4–6. 11–13 represent hall transmission paths or routes through which the hall control units 4–6 and the individual car control units 1–3 are connected with each other. 21–23 represent group supervisory control transmission paths or routes through which the individual car control units 1–3 and the group supervisory control unit 10 are connected with each other. Hall information is input to the group supervisory control unit 10 through the hall transmission paths 11–13 and the group supervisory control transmission paths 21–23.

30 represents a second hall transmission path through which the hall control unit 6 and the group supervisory control unit 10 are connected with each other, and 33 represents a switching circuit for selectively making one of the first transmission path 13 and the second transmission path 30 effective. 41 represents a power supply for the group supervisory control unit 10, and 42–44 represent power supplies for the individual car control units 1–3, respectively. The power supplies are provided independently from each other.

The group supervisory control unit 10 includes an abnormality detection section 10*a* which operates to generate a switching signal E whereby the first hall transmission path 13 is made effective to the switching circuit 33 when the power supply 44 for the individual car control unit 3 is normal, whereas the second hall transmission path 30 is made effective when the power supply 44 is down.

FIG. 11 illustrates hall button information which are transmitted through the hall transmission paths 11–13, the group supervisory control transmission paths 21–23, and the second hall transmission path 30. 71 illustrates an example of data in the case where an upward call of the hall call button 8*a* is generated.

Now, the operation of the conventional elevator system. First of all, when all the individual car control units 1–3 are operating normally, the switching circuit 33 is usually connected with a point of contact a as depicted by a solid line. The hall information from the hall call button unit 9 is picked up from the hall control unit 6 into the group supervisory control unit 10 through the first transmission path 13, the individual car control unit 3, and the group supervisory control transmission path 23.

When an upward button of the hall call button 9*a* is pushed now, the hall control unit 6 outputs hall transmission path data 71 as hall button information. In the case of the normal operation of all the individual car control units 1–3, the hall transmission path data 71 is received by the group supervisory control unit 10 through the hall transmission path 13, the individual car control unit 3, and the group supervisory control transmission path 23.

Next, reference will be made to the hall information transmission operation of the hall call button unit 9 when the power supply for the individual car control unit 3 of the elevator car #3 fails.

The abnormality detection section 10*a* in the group supervisory control unit 10 is comprised of a relay which is operatively connected with the power supply 44 of the individual car control unit 3. Thus, if the relay detects that the power supply 44 of the individual car control unit 3 goes down, the abnormality detection section 10*a* outputs a switching signal E so that the connection is changed to a point of contact b of the switching circuit 33 as shown by a broken line.

As a result, the hall information issued by the hall call button unit 9 is transmitted from the hall control unit 6 to the group supervisory control unit 10 through the second transmission path 30. Thus, even when the power supply for the individual car control unit 3 fails, the hall information on the hall call button unit 9 is picked up and sent to the group supervisory control unit 10 and hence becomes effective.

Accordingly, when the upward button of the hall call button 9*a* is pushed, the hall control unit 6 outputs the hall transmission path data 71 in the form of hall button information. When the power supply 44 of the individual car control unit 3 is down, the hall transmission path data 71 is received by the group supervisory control unit 10 through the hall transmission path 13 and the second hall transmission path 30.

With the conventional elevator group supervisory control system as described above, connections are made in such a manner that the hall information from the hall call buttons is picked up by each of adjoining individual car control units 1, 2, which share this hall information for backup purposes, thus resulting in a problem that a lot of wiring is required.

In addition, the conventional elevator group supervisory control system is constructed such that when the power supply for the individual car control unit 3 goes down, the transmission lines or paths are switched over to send the hall information of the hall control unit 6 directly to the group supervisory control unit 10. Therefore, when the group supervisory control unit 10 goes down, the elevator service by the individual car control unit 3 alone can only be done for the hall information of the hall call button unit 9, thus posing another problem in that the operating efficiency of the elevator system is worsened.

The present invention is intended to obviate the problems as described above, and has as its object to provide an elevator group supervisory control system in which wiring for hall buttons can be simplified, and which is capable of carrying out elevator service with improved operating efficiency by transmitting hall information to a plurality of individual car control units even when some of the individual car control units and/or a group supervisory control unit are down.

SUMMARY OF THE INVENTION

A first aspect of the present invention resides in an elevator group supervisory control system, characterized in that for each of individual car control units, there is provided a communication control unit, having an independent power supply, which is connected with a corresponding individual car control unit, a hall control unit and a group supervisory control unit for data communications therebetween, and that the communication control units and the group supervisory control unit are bus-connected with one another by means of a group supervisory control transmission path.

A second aspect of the present invention resides in that each of the communication control units connected with the individual car control units includes a hall button group table which stores group data information for classifying response groups of hall equipment including hall call buttons related to the hall control unit connected therewith, and a hall button data processing section which adds the group data information of the hall button group table to hall button information from the hall equipment and then transmits it to the group supervisory control transmission path.

A third aspect of the present invention resides in that all the communication control units comprise a hall button group table which stores group data information for identifying response groups of hall equipment connected therewith through the hall control unit, a group supervisory control abnormality detection section for detecting an abnormality of the group supervisory control unit based on whether or not data from the group supervisory control unit is received, and a hall button data processing section for transmitting group supervisory control transmission path data which is formed by adding group data information of the hall button group table to hall button information from the hall equipment, the hall button data processing section being operable to receive group supervisory control transmission path data added by the group data information among data from the group supervisory control transmission path and transmit the group supervisory control transmission path data thus received to the individual car control unit connected therewith when the group supervisory control unit is abnormal, wherein the group supervisory control unit includes an assignment decision section which carries out group supervisory control according to the group supervisory control transmission path data from the communication control units, and assigns based thereon elevators to the individual car control units through the communication control units.

A fourth aspect of the present invention resides in that each of the communication control units comprises hall button group tables which store normal-operation group data information and abnormal-operation group data information, respectively, for identifying response groups of hall equipment connected therewith through the hall control unit, a group supervisory control abnormality detection section for detecting an abnormality of the group supervisory control unit based on whether or not data from the group supervisory control unit is received, and a hall button data processing section for transmitting group supervisory control transmission path data which is formed by adding group data information of the hall button group tables according to a normality or an abnormality of the group supervisory control unit to hall button information from the hall equipment, the hall button data processing section being operable to receive group supervisory control transmission path data added by the abnormal-operation group data information among data from the group supervisory control transmission path and transmit the group supervisory control transmission path data thus received to the individual car control unit connected therewith when the group supervisory control unit is abnormal, wherein the group supervisory control unit includes an assignment decision section which carries out group supervisory control according to the group supervisory control transmission path data from the communication control units, and assigns based thereon elevators to the individual car control units through the communication control units.

A fifth aspect of the present invention resides in that each of the communication control units includes a plurality of hall button group tables which store group data information for identifying response groups of hall equipment connected therewith through the hall control unit, and a hall button data processing section which adds group data information according to an operating condition of an elevator system to hall button information from the hall equipment and then transmits it as group supervisory control transmission path data, the hall button data processing section being operable to receive group supervisory control transmission path data added by the group data information according to the operating condition of the elevator system among data from the group supervisory control transmission path and transmit the group supervisory control transmission path data thus received to the individual car control unit connected therewith.

A sixth aspect of the present invention resides in that the hall equipment including hall call buttons are connected with one individual car control unit of a plurality of elevators which share the hall equipment.

In the elevator group supervisory control system of the present invention, there are provided communication control units each of which is connected with a hall control unit, an individual car control unit and a group supervisory control unit for data communications therebetween. Communication paths of each communication control unit and the group supervisory control unit are connected with each other through buses. With this arrangement, even when an individual car control unit connected with a communication control unit is put into an abnormal state such as a power supply down, etc., hall information on hall call buttons is transmitted to the group supervisory control unit via the communication control unit, so that a group supervisory control assignment of elevators can be made.

Moreover, a hall button group table for classifying the response groups of hall buttons connected is provided in each communication control unit connected with an individual car control unit, so that the group supervisory control unit is able to carry out operation control with good efficiency while taking account of hall button groups.

In addition, hall button group tables are provided in all communication control units connected with the individual car control units, and each communication control unit is able to receive hall information on the hall button groups registered in a hall button group table to be used. Thus, hall information on all the hall call buttons is connected to the communication control units via bus transmission paths, so that each individual car control unit is able to select and receive the data of the hall button groups registered in its hall button group table, performing elevator control based thereon.

Further, a plurality of hall button group tables are provided in a communication control unit connected with an individual car control unit, and a hall button group table to be used can be switched over to another one according to the operating condition of an elevator system. Accordingly, a hall control unit carries out group supervisory control processing in accordance with a predetermined hall button group table of the communication control unit, but even when the group supervisory control unit becomes abnormal, the elevator service can be carried out by changing the elevator system configuration while using another hall button group table.

BEST MODES FOR CARRYING OUT THE INVENTION

Hereinafter, respective preferred embodiments of the present invention will now be described while referring to the accompanying drawings.

Embodiment 1.

Figure 1:
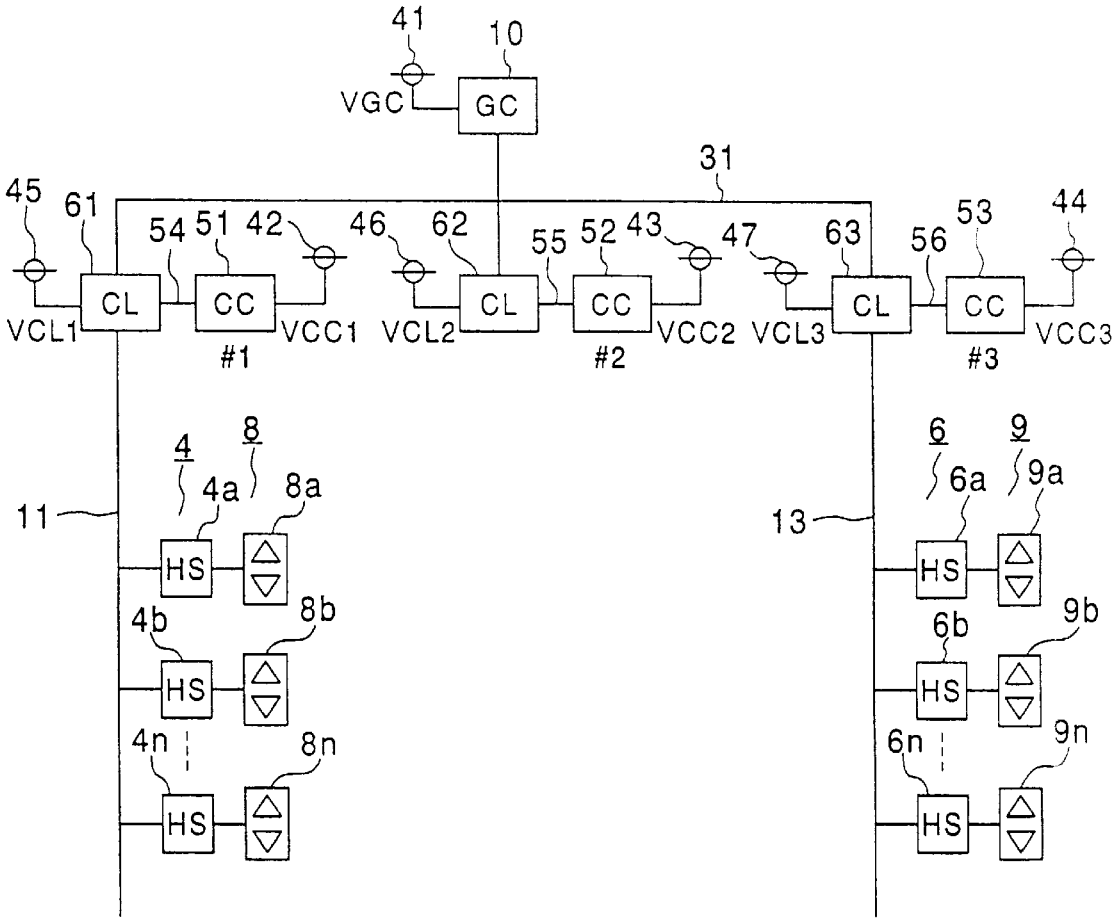
FIG. 1 is a constructional view of one example of an elevator group supervisory control system according to the present invention.

FIG. 1 is a view illustrating one example of the construction of an elevator group supervisory control system according to the present invention. In FIG. 1, 51–53 represent individual car control units (designated at "CC" in this figure) which individually control three elevator units #1–#3 (not shown), and which include no hall button communication processing section and no group supervisory control communication processing section. 61–63 represent communication control units (designated at "CL" in the figure) connected with the individual car control units 51–53. 4, 6, 8, 9, 10 and 41–44 represent the same as in the conventional system.

31 represents a group supervisory control transmission path which connects between the group supervisory control unit 10 and the communication control units 61–63 through buses. 54–56 represent individual car transmission paths which connect between the communication control units 61–63 and the individual car control units 51–53. 11 represents a hall transmission path which connects between the hall control unit 4 and the communication control unit 61, and 13 represents a hall transmission path which connects between the hall control units 6 and the communication control unit 63. 45–47 represent power supplies for the communication control units 61–63, respectively, and these power supplies are provided independently from one another so that the communication control units 61–63 are able to operate even when the individual car control units 51–53 fail or the power supplies therefor go down. For example, the power supplies 45–47 may be further provided with backup power supplies (not shown in particular) for emergency purposes.

Figure 2:
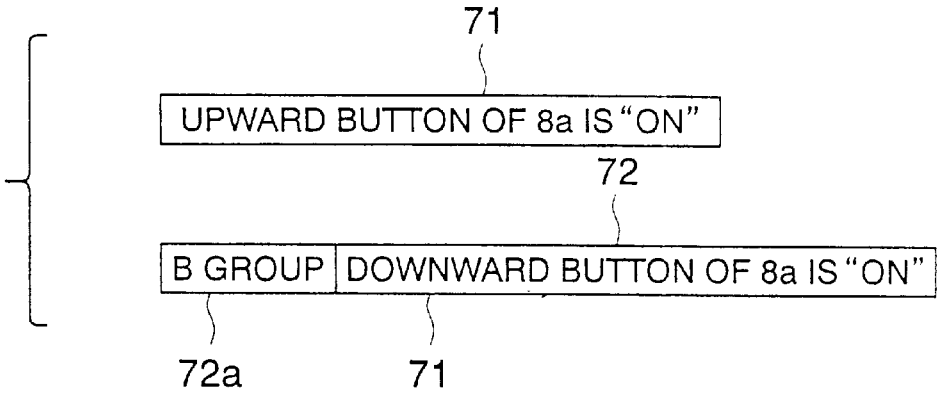
FIG. 2 is a view illustrating examples of hall button information and group supervisory control transmission path data according to the present invention.

FIG. 2 illustrates one example of hall button information which is transmitted through the hall transmission paths 11, 13 and the group supervisory control transmission path 31. 71 represents the same hall button information as that in the conventional system. 72 represents group supervisory control transmission path data which is formed of the hall button information 71, which is transmitted through the group supervisory control transmission path 31, added by group data information 72*a* to be described later.

Figure 3:
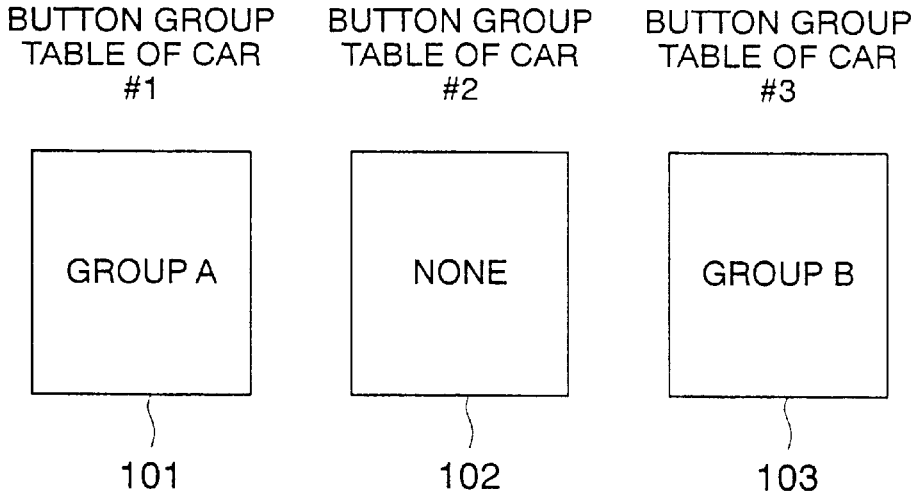
FIG. 3 is a view illustrating one example of a hall button group table in a first embodiment of the present invention.

FIG. 3 illustrates hall button group tables 101–103 for classifying the groups of hall call button units 8 and 9 from each other, which constitute hall equipment provided in the communication control units 61–63 connected with the individual car control units 51–53.

Figure 4:
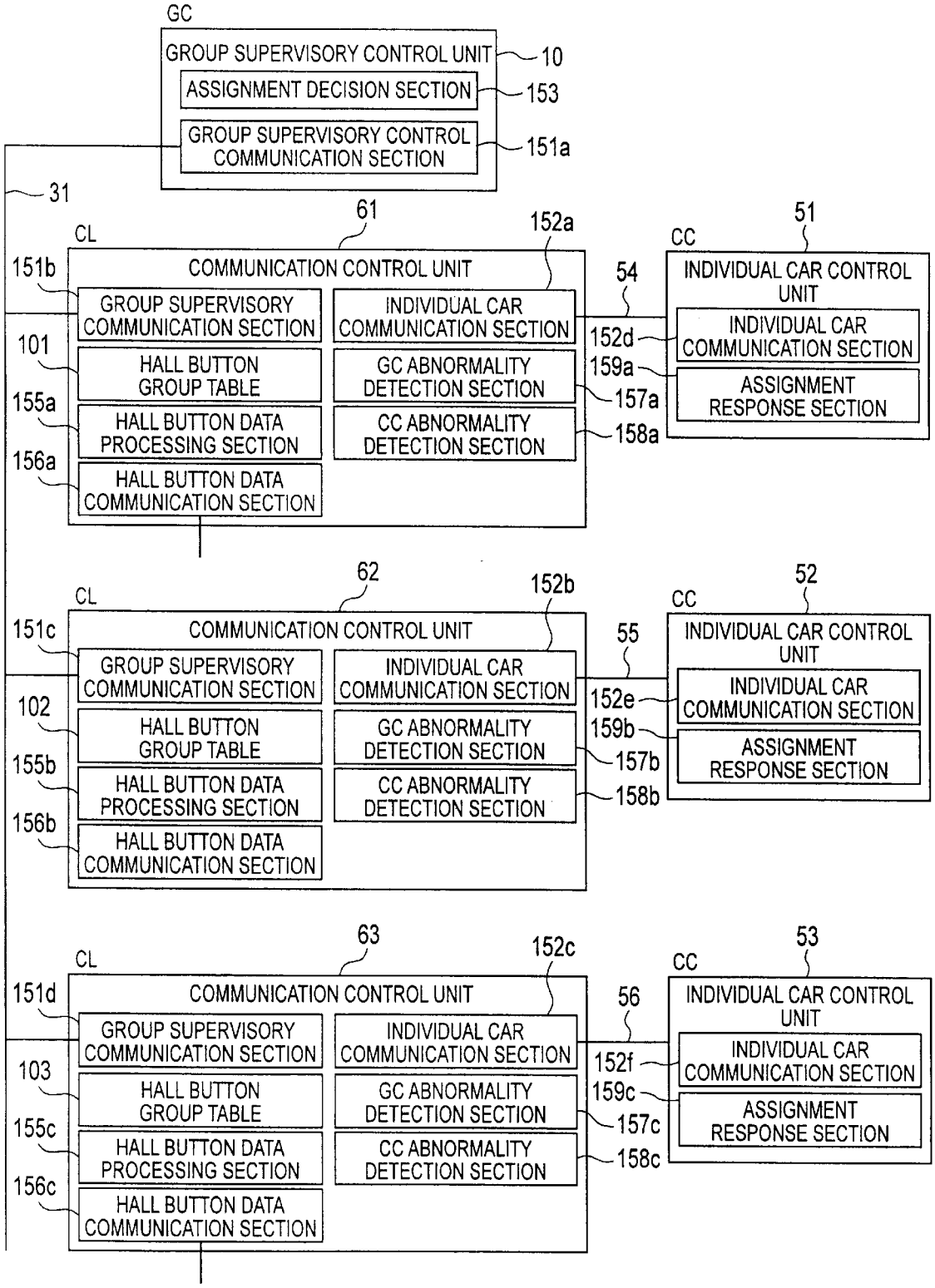
FIG. 4 is a functional block diagram of an elevator group supervisory control system according to the present invention.

FIG. 4 illustrates a functional block diagram of the elevator group supervisory control system according to one embodiment of the present invention. Here, note that FIG. 4 collectively illustrates the functions of all the embodiments of the present invention.

In FIG. 4, 151 represents group supervisory communication sections which carry out communication processing between the group supervisory control unit 10 and the respective communication control units 61–63. 152 represents individual car communication sections which carry out communication processing between the individual car control units 51–53 and the communication control units 61–63. 153 represents an assignment decision section for carrying out the assignment of elevator cars based on group supervisory control. 156 represents hall button data communication sections for sending and receiving hall button information. 101–103 represent hall button group tables showing group data information for the hall equipment connected with the communication control units 61–63. 155 represents hall button data processing sections which send the hall button information received with the group data information of the hall button group tables 101–103 added thereto to the group supervisory control transmission path 31, and which receive the group supervisory control transmission path data with the corresponding group data information added thereto on the group supervisory control transmission path 31. 157 represents group supervisory (GC) abnormality detection sections for determining whether the group supervisory control unit 10 is abnormal, according to the receipt or non-receipt of a signal from the group supervisory control unit 10. 158 represents individual car abnormality detection sections which similarly determine whether the individual car control units 51–53 are abnormal. 159 represents assignment response sections by which individual car control units 51–53 perform assignment response processing.

The operation of the present invention will now be described according to FIGS. 1–4. The reason why there is no group data in the hall button group table 102 in the communication control unit 62 in FIG. 3 is that the hall transmission path with which the hall control units are connected is not connected with the communication control unit 62. Also, the fact that the group table of the car #1 and the group table of the car #3, that is, the hall button group table 101, 103 in the communication control units 61 and 63, are different from each other means an elevator system having two (two kinds of) hall buttons on the same floor for instance.

Figure 5:
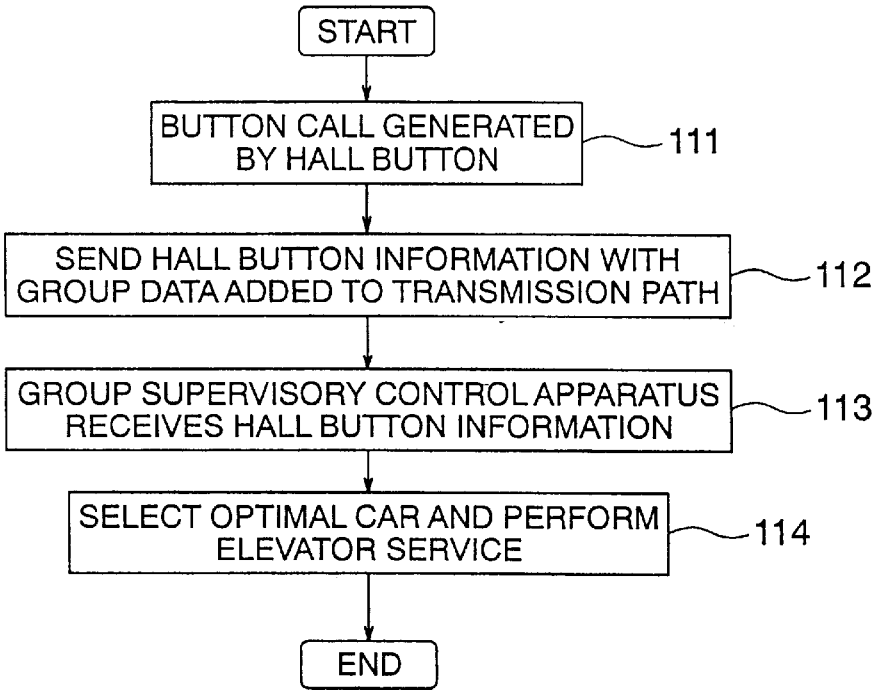
FIG. 5 is a flow chart for explaining the operation of the first embodiment of the present invention.

Next, reference is made to one example of hall information transmission operation using FIG. 5. When a hall call is generated by the hall call button 8*a*, which is hall equipment (in 111), hall button information 71 is transmitted to the communication control unit 61 through the hall transmission path 11, and received by a hall button data communication section 156*a*. The hall button data processing section 155*a* prepares, based on the data of the hall button group table 101, group supervisory control transmission path data 72 by adding group data information 72*a* indicative of group A to the hall button information 71 received. The group supervisory control transmission path data 72 is transmitted to the group supervisory control transmission path 31 by means of a group supervisory communication section 154*b* (in 112). A group supervisory communication section 151*a* in the group supervisory control unit 10 receives this group supervisory control transmission path data 72 (in 113). The group supervisory control unit 10 selects and assigns, based on the hall button information 71 of the received group supervisory control transmission path data 72, an optimal car or cars by means of the assignment decision section 153 (in 114).

Now, reference will be made to a hall button information transmission operation when the power supply 42 for the individual car control unit 51 of elevator unit # 1 is down. Since the power supplies 42–44 of the individual car control units 51–53 and the power supplies 45–47 of the communication control units 61–63 are independent from each other in this embodiment, the group supervisory control transmission path data 72 of the hall call button unit 8 is similarly transmitted to the group supervisory control unit 10 through the communication control unit 61 even if the power supply 42 for the individual car control unit 51 goes down (in 112). In the group supervisory control unit 10, the assignment decision section 153 selects and assigns an optimal car or cars based on the hall button information of the group supervisory control transmission path data 72 (in 114).

Embodiment 2.

Figure 6:
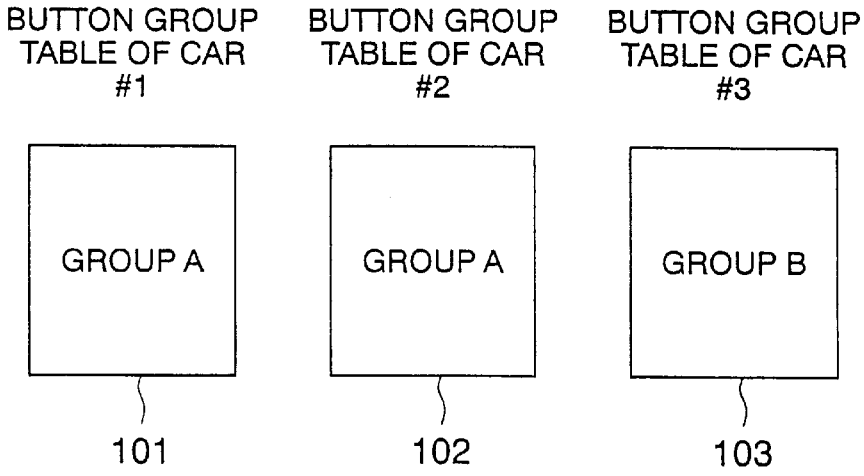
FIG. 6 is a view illustrating one example of a hall button group table in a second embodiment of the present invention.

FIG. 6 illustrates hall button group tables 101–103 representative of response groups provided in the communication control units 61–63 in an elevator group supervisory control system according to a second embodiment of the present invention.

Figure 7:
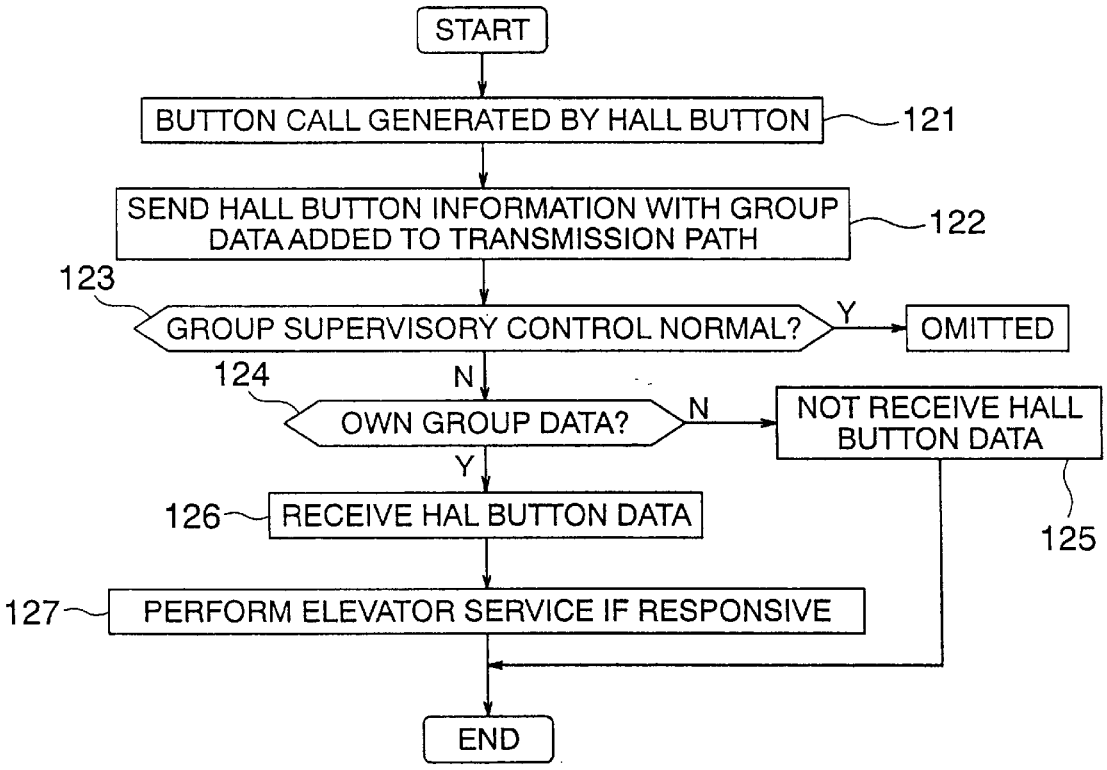
FIG. 7 is a flow chart for explaining the operation of the second embodiment of the present invention.

Now, one example of the operation of this embodiment will be illustrated in FIG. 7. When a hall call is generated by the hall call button 8*a* (in 121), hall button information 71 is transmitted to the communication control unit 61 through the hall transmission path 11. The hall button data communication section 156*a* in the communication control unit 61 receives the hall button information 71, and the hall button data processing section 155*a* prepares group supervisory control transmission path data 72 by adding group data 72*a* to the hall button information 71 based on a hall button group table 101. Then, the group supervisory communication section 151*b* transmits the group supervisory control transmission path data 72 thus prepared to the group supervisory control transmission path 31 (in 122). The group supervisory abnormality detection section 157 in the communication control units 61–63 determines whether the group supervisory control unit 10 is normal, depending on whether transmission path assignment processing data is able to be received from the group supervisory control transmission path 31 or not (in 123). When the group supervisory control unit 10 is normal, ordinary group supervisory control processing is executed.

On the other hand, when transmission path assignment processing data is not able to be received from the group supervisory control transmission path 31, that is, when the group supervisory control unit 10 is abnormal, the hall button data processing sections 155 determine whether it is button information to be used, while referring to the hall button group tables 101–103 (in 124). Here, note that when the group supervisory control transmission path data 72 is not registered in the hall button group tables 101–103 (i.e., it is the hall button information not to be used), the data is not received (in 125). On the other hand, the group supervisory control transmission path data 72 is received when registered in the hall button group tables 101–103 (i.e., it is the hall button information to be used) (in 126). Thereafter, the hall button information 71 in the group supervisory control transmission path data 72 received is transmitted from the individual car communication section 152 to the individual car control units 51–53 connected thereto through the individual car transmission paths 54–56. When the assignment response section 159 in each of the individual car control units is able to make a response, the elevator service is performed (in 127).

Embodiment 3.

Figure 8:
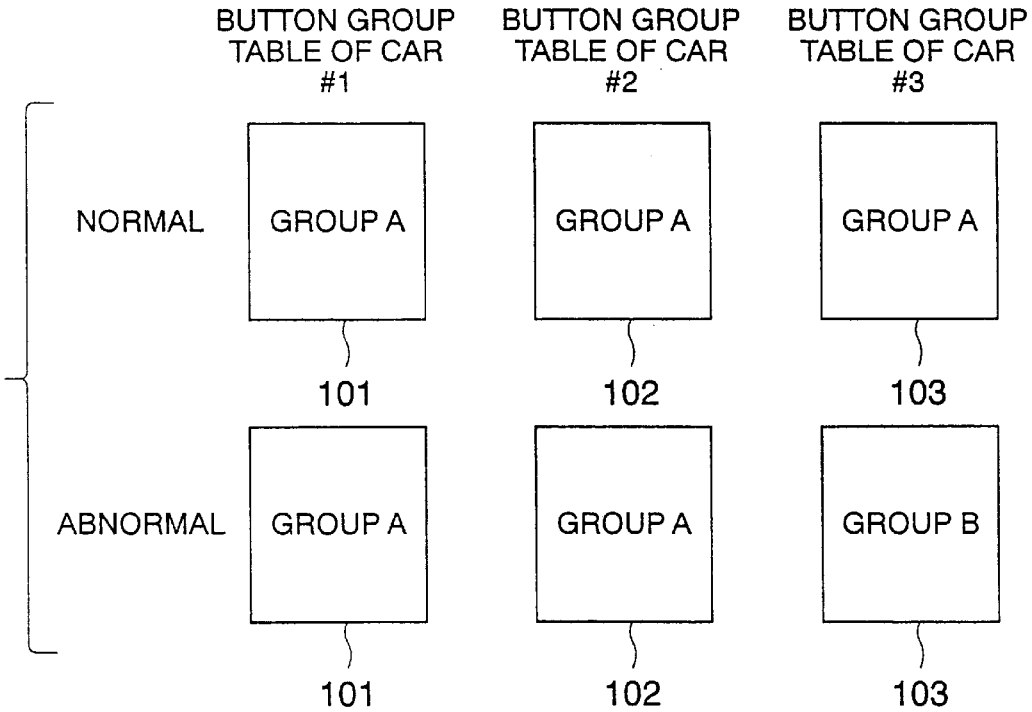
FIG. 8 is a view illustrating one example of a hall button group table in a third embodiment of the present invention.

FIG. 8 illustrates hall button group tables 101–106 representative of response groups in a normal and an abnormal operation, respectively, provided in communication control units 61–63 in an elevator group supervisory control system according to a third embodiment of the present invention.

Figure 9:
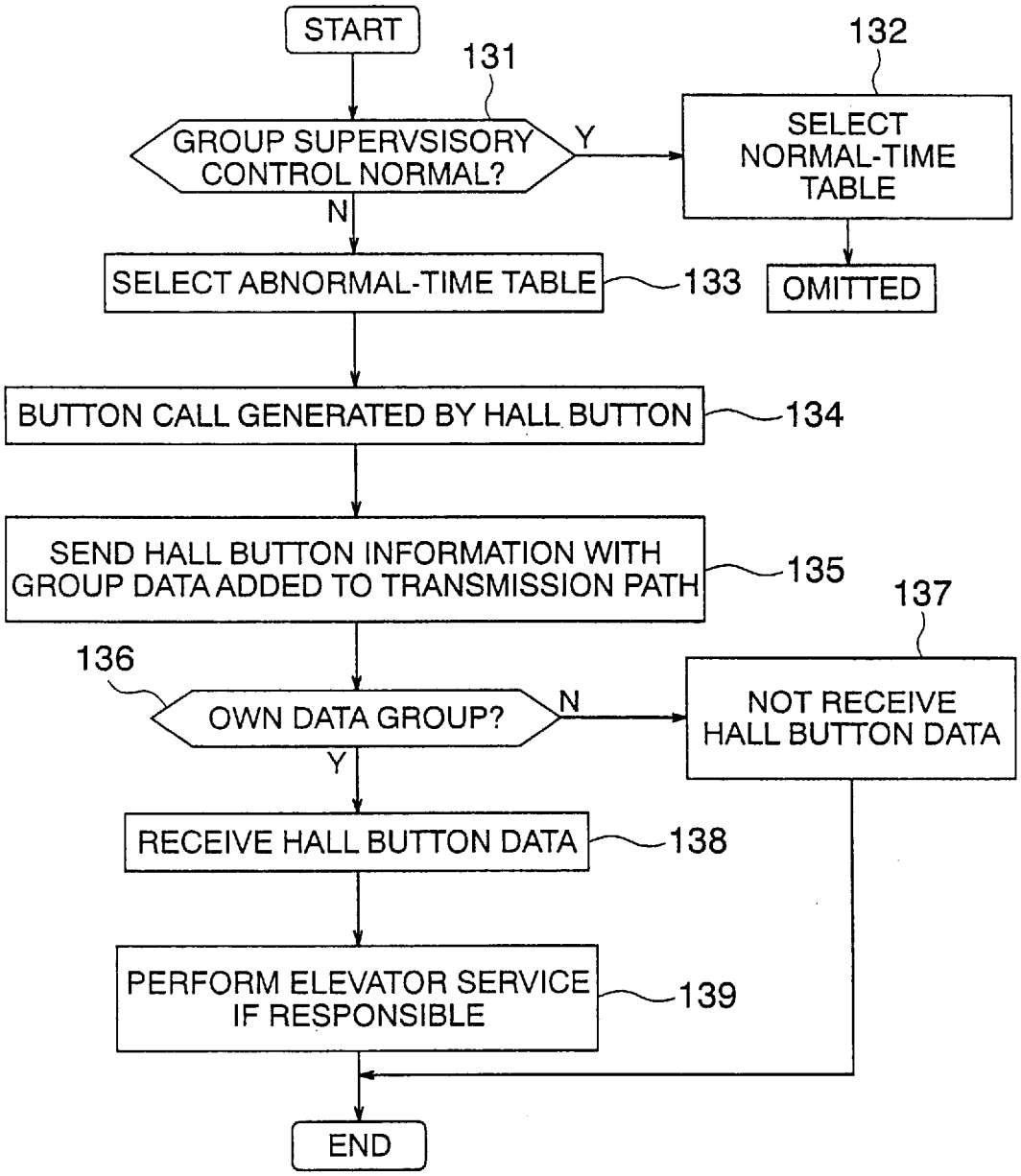
FIG. 9 is a flow chart for explaining the operation of the third embodiment of the present invention.
Figure 10:
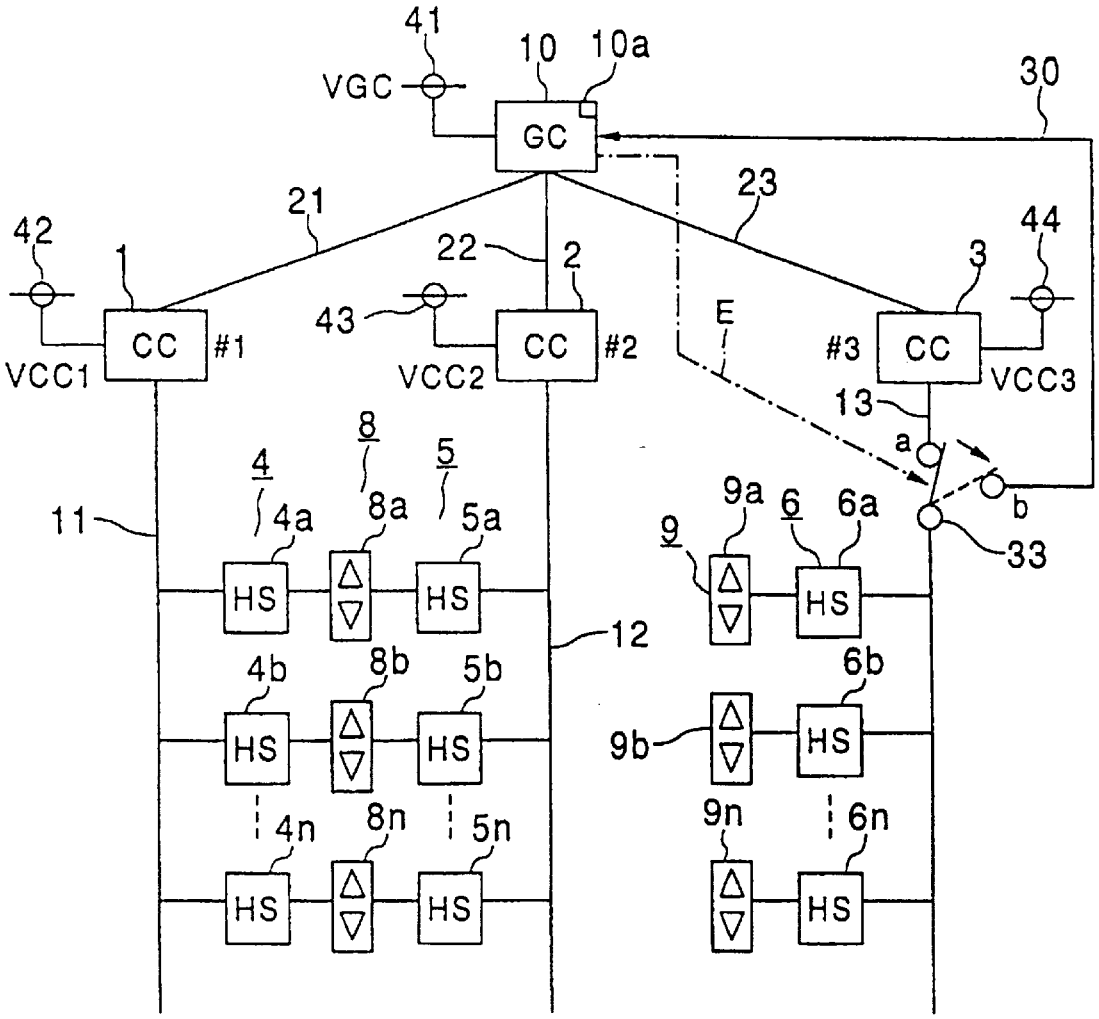
FIG. 10 PRIOR ART
FIG. 10 is a constructional view of the conventional elevator group supervisory control system.
Figure 11:
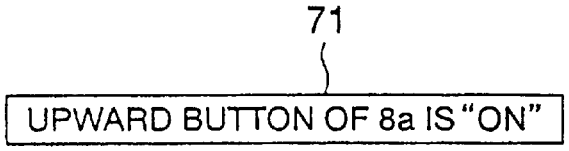
FIG. 11 PRIOR ART
FIG. 11 is a view illustrating one example of hall button information in the conventional elevator group supervisory control system.

Now, reference will be made to one example of the operation of this embodiment illustrated in FIG. 9. The communication control units 61–63 determines whether the group supervisory control unit 10 is normal, for example, by means of the group supervisory abnormality detection section 157 (in 131). When the group supervisory control unit 10 is normal, the hall button data processing sections 155 select hall button group tables 101–103 and carry out usual group supervisory control processing (in 132). When the group supervisory control unit 10 is abnormal, the hall button data processing sections 155 select hall button group tables 104–106 and carry out communication processing (in 133).

At this time, when a hall call is generated by the hall call button 8*a* (in 134), hall button information 71 is transmitted to the communication control unit 61 through the hall transmission path 11. The communication control unit 61 adds, based on internal hall button group table 104, group data information to the hall button information 71 to provide group supervisory control transmission path data 72, which is then transmitted to the group supervisory control transmission path 31 (in 135). The group supervisory control transmission path data 72 at this time is different from one in a normal operation.

The hall button data processing sections 155 of the communication control units 61–63 determine whether the simple group supervisory control transmission path data 72, which has been transmitted via the group supervisory control transmission path 31, is the hall button information to be used, while referring to the hall button group tables 104–106 (in 136). Here, when the simple group supervisory control transmission path data 72 is not registered in the hall button group tables 104–106 respectively in the communication control units 61–63, (that is, when it is the hall information not to be used), the simple group supervisory control transmission path data 72 is not received (in 137). The simple group supervisory control transmission path data 72 is received when registered in the hall button group tables 104–106 (that is, when it is the hall information to be used) (in 138). Thereafter, the hall information thus received is transmitted to the individual car control units 51–53 connected. Then, if the assignment response section 159 in each of the individual car control units 51–53 is able to make a response, the elevator service is performed (in 139).

Here, it is to be noted that though in this embodiment, the description has been made using the hall button group tables in the case where the group supervisory control unit is abnormal, a plurality of hall button group tables may be provided according to the operating conditions of the elevator system.

INDUSTRIAL APPLICABILITY

As described above, since in the present invention, hall control units, individual car control units and a group supervisory control unit are connected with one another through communication control units, communications between the hall control units and the group supervisory control unit become effective even if some individual car control units are down. Thus, wiring is made unnecessary for connecting each call button, which is connected with a corresponding hall control unit, with a plurality of hall control units for backup purposes, thereby providing an effect of enabling the arrangement of connections to be simplified.

Moreover, in particular, each communication control unit is provided with a hall button group table which stores group data information for classifying response groups of hall equipment including hall call buttons related to hall control units connected therewith, and a hall button data processing section which adds group data information of the hall button group table to hall button information from the hall equipment and then transmit it to a group supervisory control transmission path. Thus, even if a certain individual car control unit goes down, it is still possible to carry out efficient operation control by means of the group supervisory control unit while taking account of hall button groups.

In addition, by providing all the communication control units with hall button group tables for supervising or managing the hall button groups, there is obtained an effect that each individual car control unit can utilize hall information common to the hall button groups connected with other individual car control units by appropriately setting the hall button group tables.

Further, hall button group tables for normal and abnormal operations, respectively, of the group supervisory control unit may be provided in such a manner as to be switched over in accordance with the operating condition thereof, and hall button information of the same hall button group can be received by a plurality of individual car control units. With such an arrangement, there is obtained an effect that in case where the group supervisory control unit becomes abnormal for instance, it is possible to construct a simple group supervisory control system in each unit of the same hall button group.

Furthermore, a plurality of hall button group tables may be provided in accordance with the operating condition of the elevator system, and control or management tables for the hall button groups can be switched over in accordance with the operating conditions of elevators. In addition, hall button information of the same hall button group can be received by a plurality of individual car control units. With such an arrangement, there is obtained an effect that a simple group supervisory control system can be constructed which is varied in accordance with the elevator operating conditions.

Besides, hall equipment including hall call buttons is connected through a hall control unit with a communication control unit which is connected with one individual car control unit of a plurality of elevators which share the hall equipment. This provides an effect that the arrangement of connections can be simplified.

What is claimed is:

1. An elevator group supervisory control system including, for each of individual car control units, a hall control unit, a communication control unit, having an independent power supply, connected with the corresponding individual car control unit, and a group supervisory control unit for data communications between said communication control units and said hall control unit, said communication control units and said group supervisory control unit being connected with one another through a bus via a group supervisory control transmission path, wherein each of said communication control units connected with said individual car control units includes a hall button group table which stores group data information for classifying response groups of hall equipment each of said communication control units including hall call buttons related to said hall control unit connected therewith, and a hall button data processing section which adds the group data information of the hall button group table to hall button information from the hall equipment and then transmits the hall button information through the group supervisory control transmission path.

2. An elevator group supervisory control system including, for each of individual car control units, a hall control unit, a communication control unit, having an independent power supply, connected with the corresponding individual car control unit, and a group supervisory control unit for data communications between said communication control units and said hall control unit, said communication control units and said group supervisory control unit being connected with one another through a bus via a group supervisory control transmission path, wherein each of said communication control units comprises a hall button group table which stores group data information for identifying response groups of hall equipment connected therewith through said hall control unit, a group supervisory control abnormality detection section for detecting an abnormality of said group supervisory control unit based on whether data from said group supervisory control unit is received, and a hall button data processing section for transmitting group supervisory control transmission path data which is formed by adding group data information of the hall button group table to hall button information from the hall equipment, said hall button data processing section receiving group supervisory control transmission path data added to the group data information among data from the group supervisory control transmission path, and transmitting the group supervisory control transmission path data thus received to said individual car control unit connected therewith when said group supervisory control unit is abnormal, wherein said group supervisory control unit includes an assignment decision section which carries out group supervisory control according to the group supervisory control transmission path data from said communication control units, and assigns, based thereon, elevators to said individual car control units through said communication control units.

3. An elevator group supervisory control system including, for each of individual car control units, a hall control unit, a communication control unit, having an independent power supply, connected with the corresponding individual car control unit, and a group supervisory control unit for data communications between said communication control units and said hall control unit, said communication control units and said group supervisory control unit being connected with one another through a bus via a group supervisory control transmission path, wherein each of said communication control units comprises hall button group tables which store normal-operation group data information and abnormal-operation group data information, respectively, for identifying response groups of hall equipment connected therewith through said hall control unit, a group supervisory control abnormality detection section for detecting an abnormality of said group supervisory control unit based on whether data from said group supervisory control unit is received, and a hall button data processing section for transmitting group supervisory control transmission path data which is formed by adding group data information of the hall button group tables, according to normality or abnormality of said group supervisory control unit, to hall button information from the hall equipment, said hall button data processing section receiving group supervisory control transmission path data added to the abnormal-operation group data information among data from the group supervisory control transmission path and transmitting the group supervisory control transmission path data thus received to said individual car control unit connected therewith when said group supervisory control unit is abnormal, wherein said group supervisory control unit includes an assignment decision section which carries out group supervisory control according to the group supervisory control transmission path data from said communication control units, and assigns, based thereon, elevators to said individual car control units through said communication control units.

4. An elevator group supervisory control system including, for each of individual car control units, a hall control unit, a communication control unit, having an independent power supply, connected with the corresponding individual car control unit, and a group supervisory control unit for data communications between said communication control units and said hall control unit, said communication control units and said group supervisory control unit being connected with one another through a bus via a group supervisory control transmission path, wherein each of said communication control units includes a plurality of hall button group tables which store group data information for identifying response groups of hall equipment connected therewith, through said hall control unit, and a hall button data processing section which adds group data information according to an operating condition of an elevator system to hall button information from the hall equipment and transmits the hall button information as group supervisory control transmission path data, said hall button data processing section receiving group supervisory control transmission path data added to the group data information according to the operating condition of said elevator system, among data from the group supervisory control transmission path, and transmitting the group supervisory control transmission path data thus received to said individual car control unit connected therewith.

5. The elevator group supervisory control system according to claim 1, wherein the hall equipment includes said hall call buttons and is connected with one individual car control unit of a plurality of elevators which share the hall equipment.

6. The elevator group supervisory control system according to claim 2, wherein the hall equipment includes hall call buttons and is connected with one individual car control unit of a plurality of elevators which share the hall equipment.

7. The elevator group supervisory control system according to claim 3, wherein the hall equipment includes hall call buttons and is connected with one individual car control unit of a plurality of elevators which share the hall equipment.

8. The elevator group supervisory control system according to claim 4, wherein the hall equipment includes hall call buttons and is connected with one individual car control unit of a plurality of elevators which share the hall equipment.

* * * * *